United States Patent [19]

Livera

[11] Patent Number: 4,866,331

[45] Date of Patent: Sep. 12, 1989

[54] EYELET FOR INCANDESCENT LAMP BASES AND METHOD OF MAKING

[75] Inventor: Phillip A. Livera, Cedar Groove, N.J.

[73] Assignee: North American Philips Corporation, New York, N.Y.

[21] Appl. No.: 76,437

[22] Filed: Jul. 22, 1987

[51] Int. Cl.[4] ..... H01J 3/48

[52] U.S. Cl. ..... 313/318; 313/317; 313/316; 313/348

[58] Field of Search ..... 313/318, 317, 316, 348; 439/375, 605, 611, 753

[56] References Cited

U.S. PATENT DOCUMENTS

| | | | |
|---|---|---|---|
| 4,029,387 | 6/1977 | Eager | 313/318 |
| 4,119,880 | 10/1978 | Wilcox et al. | 313/349 |
| 4,229,674 | 10/1980 | Hoet | 313/348 |
| 4,485,326 | 11/1984 | Hellwig et al. | 313/318 |

FOREIGN PATENT DOCUMENTS

| | | | |
|---|---|---|---|
| 680378 | 2/1964 | Canada | 313/175 |
| 2077992 | 12/1981 | United Kingdom | 313/318 |

*Primary Examiner*—Leo H. Boudreau
*Assistant Examiner*—Michael Razavi

[57] ABSTRACT

An improved lamp base having an eyelet with prongs and a base and apertures between the prongs and the base into which part of the glass insulator hardens to interlock the insulator with the eyelet.

7 Claims, 1 Drawing Sheet

EYELET FOR INCANDESCENT LAMP BASES AND METHOD OF MAKING

This is an invention in the lamp art. More particularly it provides an improved lamp base for incandescent lamps.

In producing incandescent lamp bases a brass eyelet, an aluminum shell and glass insulation are joined together on a glass basing machine. The brass eyelet and the aluminum shell are held on the machine in proper relationship to each other while molten glass is introduced into the shell. The glass upon hardening forms the insulation for the lamp base and unites the shell and eyelet.

In the past the eyelet has been made with five pointed prongs which were encapsulated in the glass. This was thought to render the eyelet less likely to come loose from the lamp base. While the provision of prongs on eyelets has reduced the failure rate of lamp bases due to loose eyelets it did not do away with that problem altogether. It is thought that sometimes when the prongs on eyelets come in contact with the molten glass they become annealed. As a result they are able to slip more easily from the glass. Moreover, the shape of the prongs with their relatively wide bases and pointed tips lends itself to loosening.

It is an object of this invention to provide an improved incandescent lamp base.

One of the features of the invention is the provision of apertures between the prongs of an eyelet and its base. These apertures are filled with glass during the glassing operation. As a result the eyelet is interlocked with the glass insulation of the lamp base.

One of the advantages of the invention is the reduction in the number of defective lamps due to loose eyelets.

In accordance with one aspect of the invention there is provided a base construction for a lamp including a conductive shell. An insulating portion partially fills the conductive shell. A metal eyelet is located in the insulating portion. The eyelet includes a base and a plurality of prongs adjacent each other extending from the base. A separate associated aperture is located between at least some of the prongs and the base. Each aperture is filled with some of the insulating portion of the lamp whereby the eyelet is interlocked with the insulating portion by the amount of insulating portion in each aperture.

In accordance with another aspect of the invention there is provided a method of manufacturing an eyelet for a lamp base including punching a metal blank to form said eyelet with a base and a plurality of prongs. The prongs are adjacent each other and extend from the base. They comprise a slotted wall cylinder like element with a longitudinal axis. At least some of the prongs are wide enough at the base that the sides of each where the sides join the base will shear upon being bent to form a predetermined angle with the longitudinal axis. The method also includes bending these wide enough prongs to the predetermined angle.

Other objects, features and advantages of the invention will become apparent to those skilled in the art from the following description and appended claims when taken in consideration with the accompanying drawing in which:

Figure 1:
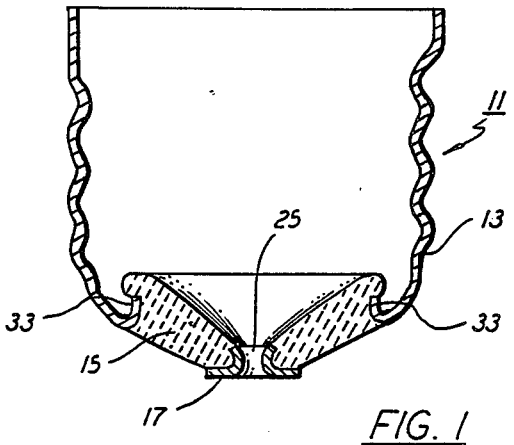
FIG. 1 shows a typical incandescent lamp base.

Referring to FIG. 1 of the drawing there is shown a lamp base 11. At the illustrated stage of manufacturing base 11 includes aluminum shell 13. Partially filling shell 13 is insulating portion 15. Encapsulated in insulated portion 15 is eyelet 17.

Figure 2:
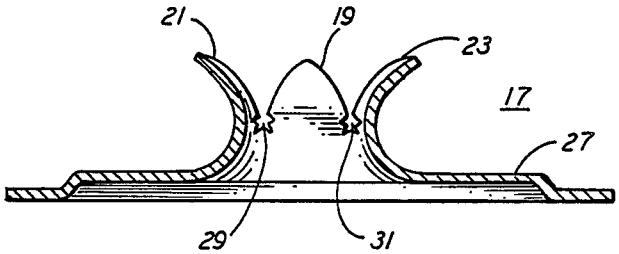
FIG. 2 is an enlarged sectional view of an eyelet made in accordance with the invention.
Figure 3:
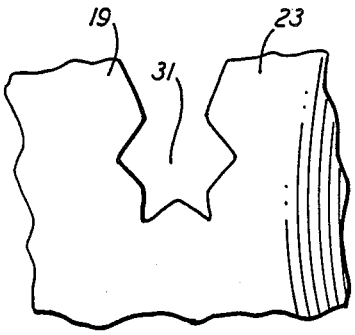
FIG. 3 is a still larger enlargement of a portion of the eyelet of FIG. 2.

FIG. 2 shows in section half an eyelet made in accordance with the invention. Preferably the eyelet has four prongs formed with a four edged nail punch. One full prong 19 and two halves of two other prongs 21 and 23 are illustrated. In accordance with the invention each of the prongs is bent backwards from opening 25 (FIG. 1) of the eyelet until it is approximately 45° from the vertical. In doing this a fracture is formed on each side of each prong where it meets base 27 of the eyelet. The fractures of adjacent prongs 19, 21 and 23 are shown as apertures 29 and 31. As shown in FIG. 3 aperture 31 comprises defined but irregular recesses.

In manufacturing eyelet 17 a well known standard metal blank is punched with a four edged nail punch to form the eyelet with a base and four prongs. The prongs extend from the base adjacent each other and comprise a slotted wall cylinder like element with a longitudinal axis. Each of the prongs is bent to form an approximate 45° angle with the longitudinal axis. Each of the prongs is wide enough at the base that its sides at the base shear upon being so bent.

In manufacturing a lamp base such as 11, tubular shell 13 is held with its lip 33 down and its opposite end up in a prescribed mold. An eyelet, such as 17, is located in the mold at the center of the shell a predetermined distance below its lip. A gob of a predetermined amount of molten glass is then deposited inside the tubular shell. A water cooled pointed plunger presses into the molten glass to force it around the lip of the shell and around the eyelet. It is also forced between the eyelet and the lip. Because of the mold and the plunger, the glass insulation which is formed when the molten glass hardens has the shape shown in FIG. 1.

As those skilled in the art will understand when the molten glass is forced around eyelet 17 some of the glass is squeezed into apertures such as 29 and 31. Because these apertures have defined recesses the glass which hardens in these recesses interlocks the eyelet with the glass insulator.

Eyelets with four prongs are presently preferred because the length of arc of each prong where it meets its base is long enough to fracture consistently when bent the above mentioned 45° . Three prong eyelets would do the same but they would have one less aperture between their bases and prongs to serves as an interlock.

Modifications to the above-described arrangement and method will become evident to those skilled in the art and the arrangement and method described herein are for that reason illustrative only and not to be considered restrictive.

What is claimed is:

1. A base construction for a lamp including a conductive shell, an insulating portion partially filling said conductive shell and an eyelet encapsulated in said insulating portion, said eyelet including a base and a plurality of prongs adjacent each other extending from said base and a separate associated aperture between at least some of said prongs and said base, each said aperture being filled with some of said insulating portion whereby said eyelet is interlocked with said insulating portion by the amount of said insulating portion in each said aperture.

2. A base construction for a lamp according to claim 1, wherein said eyelet has an aperture between each of its prongs and said base.

3. A base construction for a lamp according to claim 2, wherein said eyelet has four prongs.

4. A base construction for a lamp according to claim 3, wherein said prongs form a slotted wall cylinder like element with a longitudinal axis and are bent to form an approximate 45° angle with said longitudinal axis.

5. The method of manufacturing an eyelet for a lamp base including punching a metal blank to form said eyelet with a base and a plurality of prongs adjacent each other extending from said base, said prongs comprising a slotted wall cylinder like element with a longitudinal axis, at least some of said prongs being wide enough at said base that the sides of each where said sides join said base will shear upon being bent to form a predetermined angle with said longitudinal axis and bending said at least some of said prongs said predetermined amount.

6. A method according to claim 5, wherein each of said prongs is wide enough at said base to shear upon being bent to form said predetermined angle and each is so bent.

7. A method according to claim 6, wherein each of said prongs is bent to form an approximate 45° angle with said longitudinal axis.

* * * * *